United States Patent [19]

Fayren

[11] 4,167,148

[45] Sep. 11, 1979

[54] FLOATING APPARATUS AND METHOD OF ASSEMBLING THE SAME

[76] Inventor: Jose M. Fayren, Jose Fentanez 19 Pta., D. Puerta de Hierro, Madrid, Spain, 35

[21] Appl. No.: 832,849

[22] Filed: Sep. 13, 1977

[30] Foreign Application Priority Data

Sep. 13, 1976 [ES] Spain ..... 451.483

[51] Int. Cl.[2] ..... B63B 35/44

[52] U.S. Cl. ..... 114/265; 114/121; 405/204

[58] Field of Search ..... 9/8 R, 8 P; 114/264–267, 122, 121, 123, 61; 61/86, 87, 88, 90, 91, 92, 93, 96, 97; 405/224, 203, 204, 195, 196, 200

[56] References Cited

U.S. PATENT DOCUMENTS

| | | | |
|---|---|---|---|
| 1,436,902 | 11/1922 | Perley | 114/56 |
| 3,078,680 | 2/1963 | Wepsala | 114/265 |
| 3,507,239 | 4/1970 | Wipkink | 114/265 |
| 3,917,022 | 11/1975 | Brooks | 114/61 |
| 3,949,693 | 4/1976 | Bauer | 114/265 |

FOREIGN PATENT DOCUMENTS 2334468 11/1974 Fed. Rep. of Germany ..... 114/264

*Primary Examiner*—Trygve M. Blix
*Assistant Examiner*—D. W. Keen
*Attorney, Agent, or Firm*—Wigman & Cohen

[57] ABSTRACT

A semi-submersible floating apparatus for operating at sea and a method of assembling the same are disclosed. The apparatus comprises two or more submerged or bottom hulls supporting, by pillars, one or more working platforms or top hulls all of which are elongate floating bodies adapted to be individually constructed. The top hull is arranged transversely of the bottom hulls and is affixed by lateral connections adjacent the tops of the pillars. In assembling the apparatus, the bottom hulls are interconnected and fitted with the pillars and then ballasted until the bottom hulls are submerged. The top hull is floated until centered transversely of the bottom hulls and raised to a position for the lateral connection thereof. Alternately, the top hull is connected to the pillars and the bottom hulls are deballasted to raise the top hull above the level of the sea. Outer pillars having a frusto-conical shape are provided at the ends of each bottom hull to provide buoyant restoring moments for rocking movements of the apparatus.

5 Claims, 8 Drawing Figures

FLOATING APPARATUS AND METHOD OF ASSEMBLING THE SAME

BACKGROUND OF THE INVENTION

The present invention relates to improvements in construction of floating apparatus intended for operating at sea in unsheltered water, for example, of the type normally used for underwater oil drilling operations, for laying pipelines on the sea bed, or as a support for cranes, an industrial plant, the storage of supplies, aircraft landing sites and the like.

For the various uses indicated above, it is essential that there should be little rocking or other movement of the apparatus in response to the action of the waves. This object is achieved partially in semi-submersible platforms of the type stabilized by pillars. Such apparatus consists basically of two or more submerged hulls from which there emerges a series of pillars on which the actual working platform rests and acts as a base for the corresponding equipment and installations.

When the apparatus is in the operative position, the level of the water extends to approximately half the height of the pillars. The bottom hulls are submerged and provide the buoyancy required for floatability of the apparatus. The working platform, which will hereinafter be referred to as the top hull, is above the sea level at a height sufficient to avoid the effect of the waves. With this arrangement, the pillar assembly provides the apparatus with the stability required to avoid overturning.

Owing to the large size of such apparatus, its steel structure is very heavy and expensive. The large dimensions also give rise to constructional problems in the shipyard. Nevertheless, to obtain good seagoing conditions in rough seas and to enable very heavy equipment and sufficient consumable material to be housed in the top hull without adversely affecting the stability of the apparatus, the stabilizer columns must necessarily be as far apart as possible. This normally means a general increase in dimensions and hence increased cost and increased difficulties with respect to construction.

SUMMARY AND OBJECTS OF THE INVENTION

An object of this invention is to provide apparatus which makes possible the use of a pillar arrangement having pillars spaced apart a substantial distance and which has a considerable stabilizing effect without increasing the dimensions of the top hull.

Another object of this invention is to provide an assembly which, as a result of the configuration and dimensions of the discrete elements from which it is constructed, can be fabricated in a conventional shipyard.

According to the invention, the bottom hulls and the top hull are all constructed with an elongate configuration, so that the external shape of said hulls is similar to a conventional ship.

The bottom hulls are disposed in a parallel position to one another and the top hull extends transversely of the bottom hulls and rests on two pillars of each bottom hull.

The top hull is longer than the distance between the bottom hulls so that it projects outwardly therefrom thereby enabling supply cranes to be disposed outside the bottom hulls and, thus, greatly reducing the risk of collision between the supply ships and the pillars and bottom hulls.

The top hull may have a very small size in the direction of the length of the apparatus. This reduction in size is compensated by increasing its height and length to provide a strong member for bridging the gap between the supports of the pillars under optimum conditions. It also enables machinery and installations of various kinds to be installed in the interior of the top hull.

Since the bottom hulls are of a sufficiently greater length than the width of the top hull, outer pillars may be disposed at each of the ends of the bottom hulls to control the stability and hydrodynamic movements of the apparatus due to the waves. These outer pillars have a special shape for this purpose, so that the apparatus reacts with progressively greater force in proportion to the angle of inclination or immersion during vertical rocking movements of the apparatus. The most suitable form is that comprising frusto-conical shaped sections connected by their minor base, or similar bodies, e.g., frusto-pyramids, a hyperboloid, and so on. In each case, the throat or narrowest section is disposed near the level of the sea under normal operating conditions, so that the required attenuating effect is produced upon vertical rocking movements relative to said level. In conventional semi-submersible platforms, these pillars usually have a cylindrical shape, which does not produce the required attenuating effect.

Some of these outer pillars may be used to provide heliports thereon, and the advantage of this is that, in the event of fire in the top hull, the fire cannot spread to the heliport which can continue to be used at all times. The central pillars supporting the top hull may be inclined or be formed by pairs of elements in the form of either the letter A, H or V. These forms provide a good connection between the pillar and the bottom and top hulls and improve the behavior of the pillar with respect to flexture and, therefore, eliminate the need for ties interconnecting the bottom hulls. This is an important aspect of the invention since it allows the apparatus to be employed for certain uses, such as salvaging sunken ships or positioning heavy weights on structures situated between the two bottom hulls and below the top hull, in which case the apparatus would act as a floating portal crane.

In conventional platforms, the top hull rests on all the pillars. In this invention, the central pillars support the top hull and, apart from this, the top hull is not supported on the heads of the pillars, but rather is fitted between the latter by means of lateral connections. This is an important distinction because it enables the top hull to be slid along the pillars in the vertical direction during the construction process, as will be more clearly described hereinafter. The said lateral connections can be sheet-steel diaphragms welded externally to the strong structures of the top hull and pillars to give the necessary structural integrity. Since the said diaphragms are outside the two bodies, namely, the top hull and the pillars, they can be welded or cut without the integrity of the said bodies being affected, so that the top hull can be fitted and removed relatively simply. In this way, the apparatus may be dismantled subsequently without damaging its internal installations. The connection can also be made by screw connections with said diaphragms or simply by fitting the two structures one inside the other.

In order to reduce the thickness of the sheet metal used for the construction of the bottom hulls, compressed air can be injected into these hulls to produce an internal pressure which partially compensates for the external hydrostatic pressure and prevents sudden flooding of the bottom hulls in the event of a crack in the bottom thereof. To facilitate the surface navigation of the apparatus, the top part or deck of the bottom hulls may be raised at the end portions with respect to the rest of the deck, or the outer pillars may be situated at the end of said hulls so that the base of said pillars acts as a forecastle for seagoing purposes.

The construction of the apparatus described can be carried out according to the invention by constructing the bottom hulls and the top hull separately, the machinery and corresponding equipment being installed in the hulls.

The bottom hulls are then floated, interconnected and the pillars are fitted. This assembly is then ballasted until the water covers the bottom hulls and only the pillars emerge.

The top hull is floated separately, the properties of a floating body being used to advantage for this purpose. Under these conditions, the top hull is floated and introduced between the two pairs of central pillars. The ballast is then removed from the bottom hulls until they emerge from the water, leaving the top hull resting superposed on them in a transverse position. Suitable block and tackle systems with their ends fixed respectively to the top hull and to the top part of the central pillars are utilized to raise the top hull until it is situated in its final position adjacent to the tops of the central pillars. In this position, the final connections are made between the top hull and the pillars.

To actuate the said lifting tackle, it is preferable to use the platform mooring winches, which are situated in the outer pillars.

In the case of deep sheltered waters, the following method of assembly may be carried out: When the bottom hulls have been interconnected, they are ballasted and the assembly is submerged until only the top part of the pillars emerges from the water. The top hull is then floated between the pillars. Ballast is removed from the bottom hulls until the pillars of the apparatus lift slightly until the top hull is supported lightly on supports situated on said pillars, and remains immobilized therebetween. The lateral connections between the top hull and the pillars are then made and ballast removal is continued until the top hull emerges completely.

BRIEF DESCRIPTION OF THE DRAWINGS

The above features and other features of the invention and the possible ways in which the apparatus according to the invention may be built will readily be understood from the following description with reference to the accompanying drawings, which diagrammatically illustrate one possible embodiment given by way of example without limiting force.

In the drawings.

DETAILED DESCRIPTION OF A PREFERRED EMBODIMENT

Figure 1:
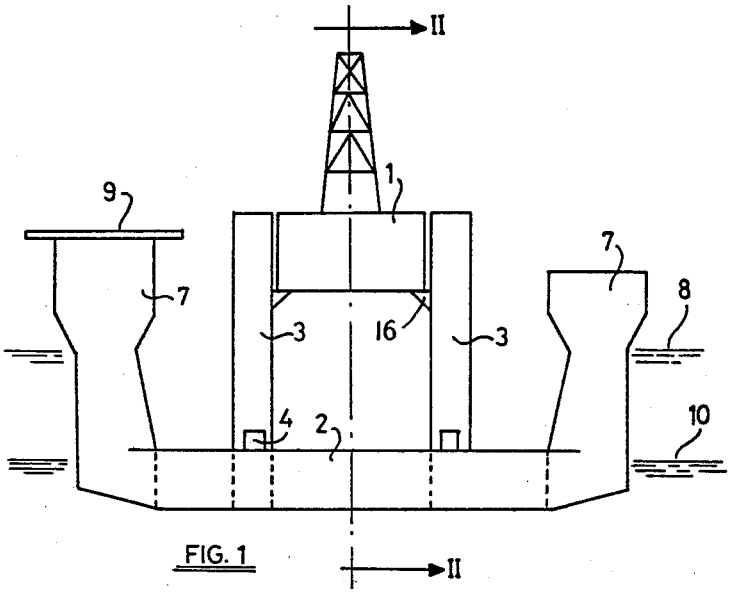
FIG. 1 is a longitudinal elevation view of the apparatus of the invention.
Figure 2:
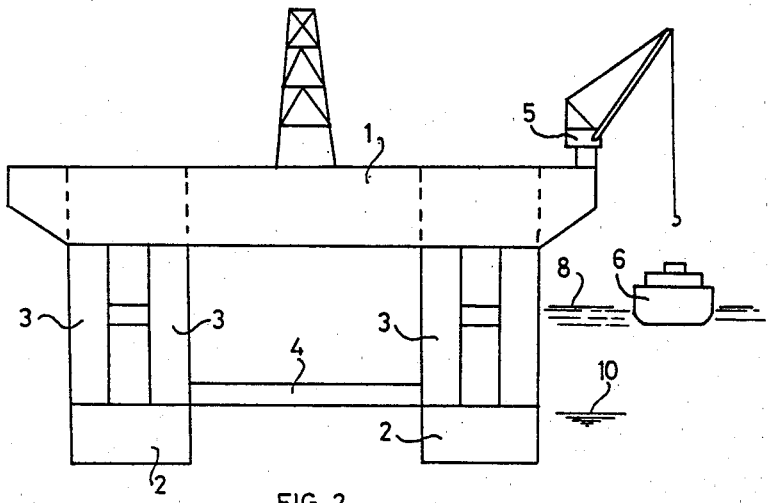
FIG. 2 is a cross-section view along the line II—II of FIG. 1.
Figure 3:
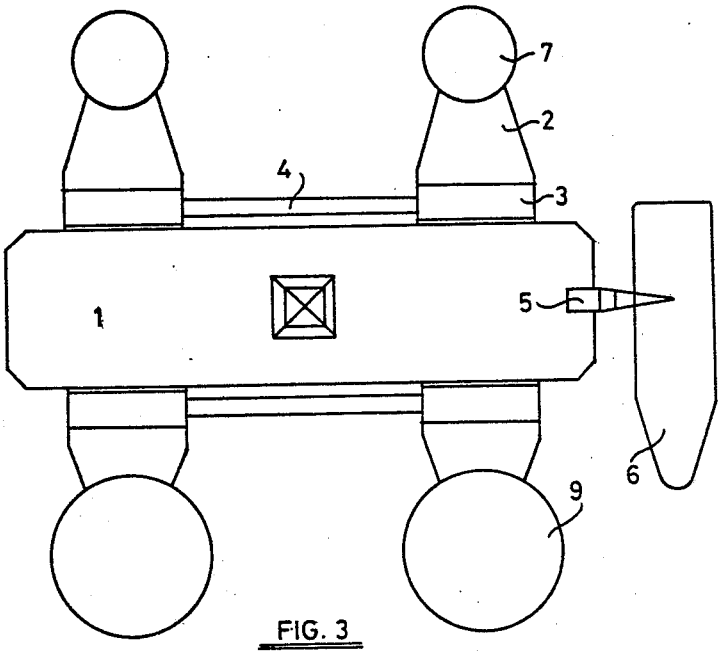
FIG. 3 is a plan view of the apparatus of the invention.
Figure 4:
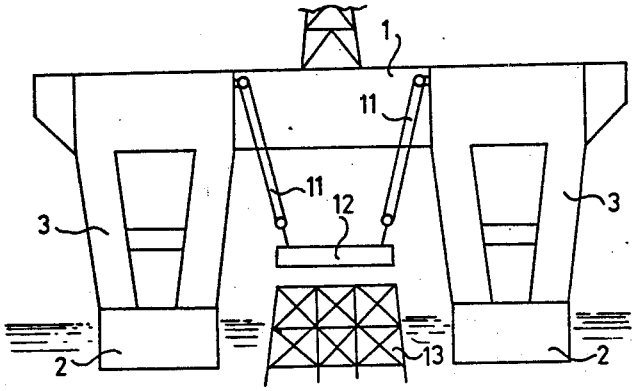
FIG. 4. is a side view of another embodiment of the invention with central pillars arranged in the form of a V, without horizontal ties, for use as a floating portal crane.

Referring to FIGS. 1, 2 and 3, the apparatus comprises a working platform or top hull 1 and two bottom hulls 2. The bottom hulls 2 and the top hull 1 both have an elongate configuration, the external shape of each of the hulls being similar to that of a conventional ship. The hulls 2 are disposed parallel to one another and the hull 1 rests on the hulls 2 by means of central pillars 3, which comprise pairs of vertical or slightly inclined interconnected elements of different configurations. FIG. 2 shows an H-shaped configuration while FIG. 4 shows a generally V-shaped configuration which assists the general distribution of weights and bending moments. These compound pillars 3 provide an optimum fit with the top and bottom hulls 1 and 2 while giving a high section modulus in respect of transverse flexure of the pillar 3. It is, therefore, possible to dispense with the transverse ties 4, shown in FIGS. 1–3, and this is very useful in various applications, since the inner space between the bottom hulls 2 is then left free of obstacles.

One of such applications is illustrated in FIG. 4. In this case, the central pillars 3 are in the form of a V and the transverse ties have been eliminated. Block and tackle systems 11 fixed to the top part of the central pillars 3 are provided for the suspension of a weighted element 12. If the latter is to be disposed on a structure 13 or on a ship, the apparatus will be moved so that the structure 13 is situated between the two bottom hulls 2. The tackle system 11 can then be actuated to deposit the element 12 on the structure 13.

This operation can be carried out even in a rough sea because all that is necessary is to increase the draft of the apparatus until the sea level is situated at the mid-height of the pillars 3, thus greatly reducing the rocking movements of the apparatus.

As will be seen from FIG. 2, the top hull 1 is extended to project beyond the pillars 3 upon which it rests, so that supply cranes 5 can be disposed at some distance from the pillar and bottom hull assembly. In this way the risk of collision between supply ships 6 and the pillars and bottom hulls is greatly reduced.

Pillars 7 are mounted at the ends of the bottom hulls 2 and, as will be seen from FIG. 1, may comprise inverted frusto-conical sections attached by the minor base thereof and a top cylindrical section. These pillars control the stability and rocking movements of the apparatus when the latter is, in the working position, submerged to the depth indicated by reference numeral 8. This special configuration of the pillars reduces the rocking movements of the apparatus.

One or more of the outer pillars 7 may be used as a heliport support 9, so that the same will be disposed away from the drilling zone, which is dangerous because of the flammable gases produced therein.

When the apparatus is at the working depth denoted by reference numeral 8 in FIGS. 1 and 2, the bottom hulls 2 are subjected to an external hydrostatic pressure. In order to reduce the stresses in said bottom hulls, means have been provided for the injection of compressed air into their interior in order to partially compensate for the pressures, while the risk of sudden flooding of the bottom hull in the event of a crack in the bottom is also avoided.

For navigation from one locality to another, the apparatus is disposed at the depth denoted by reference numeral 10. As a result of the wave motion, conventional apparatus of this kind is subject to pitching, i.e., the bow and stern periodically submerging and making navigation difficult. In the apparatus proposed according to the invention, the seagoing characteristics have been improved by disposing the outer pillars 7 at the ends of the bottom hulls 2 so that the bottom frustoconical portion of said pillars is an extension of the vertical sides of the bottom hulls. In this way, the bottom part of said pillars acts like the forecastle in conventional surface ships.

The configuration described not only provides the apparatus with good seagoing characteristics for navigation and during working, but also facilitates the construction process. The basic theory of this construction process is individual and complete prefabrication of each of the three main bodies, that is, the two bottom hulls 2 with their pillars, and the top hull 1. When these three bodies are afloat, the top hull 1 need only be positioned on the central pillars 3.

The complete prefabrication of the top hull 1, including the installation of engines and services, eliminates the laborious and expensive task of carrying out this work at a considerable height in its final position on the pillars 3.

The bottom hulls 2 are, therefore, first constructed individually in conventional installations, e.g., slipways or dry docks. After being floated, they are placed in the correct relative position and the ties 4 are fitted to interconnect the two bottom hulls. The pillars are fitted before or after this operation as convenient.

Independently of the operations described, construction of the top hull 1 is carried out, again by means of conventional installations suitable for shipbuilding. The appropriate services and machinery are installed in this hull. When the top hull has been floated, in the manner of a ship, since it is a watertight body, the problem is to place this top hull 1 in its position at the top part of the central pillars 3.

Figure 5:
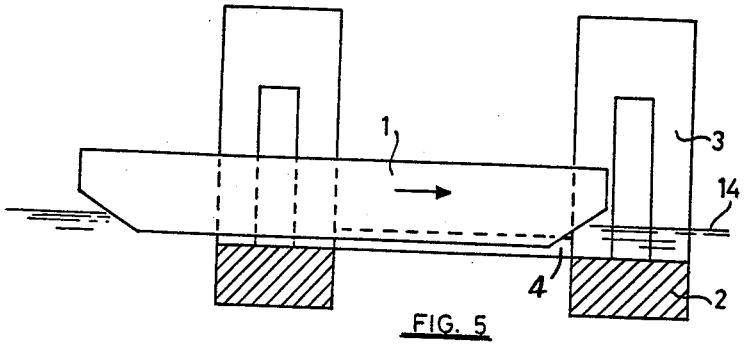
FIGS. 5, 6, and 7 illustrate three stages in the process of fitting the top hull.
Figure 6:
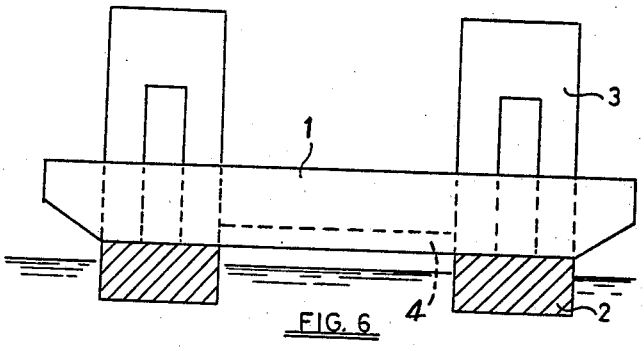
Figure 7:
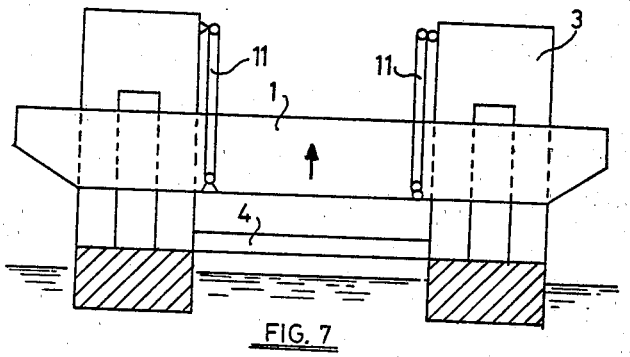

FIG. 5 shows the pair of bottom hulls 2 already interconnected by ties 4, the hulls having been ballasted until the water level is at the height denoted by reference numeral 14. The top hull 1 is floating and is introduced laterally through the two pairs of central pillars 3. When the top hull has been centered relative to the pillars, the ballast is removed from the assembly and the top hulls will rest on the bottom hulls as shown in FIG. 6. The block and tackle systems 11 (FIG. 7) are then attached with their ends being fixed to the top of the pillars 3 and to the bottom of the top hull 1 respectively. The systems 11 are actuated from mooring winches situated on the outer pillars 7 (FIG. 1) and gradually lift the top hull 1 until it reaches its final position at the top of the pillars 3, the final step being to weld the lateral connections which fix the top hull to the pillars.

Figure 8:
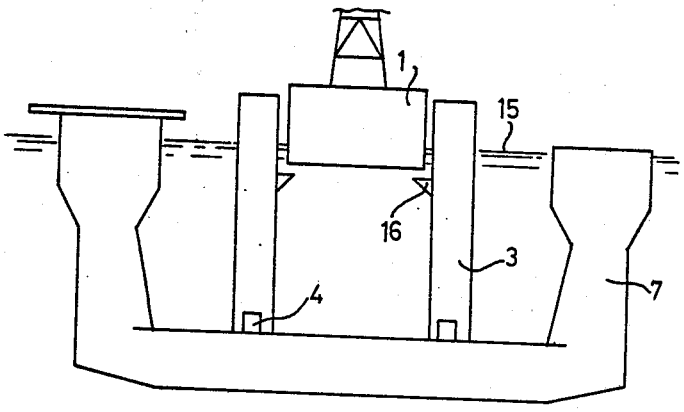
FIG. 8 illustrates another process of fitting the top hull for use in deepwater locations.

In sheltered deep water, the top hull can be put into position in the manner shown in FIG. 8. For this purpose, the two bottom hulls 2, interconnected by the ties 4, are ballasted until the water level is at the position designated by reference numeral 15. The top hull 1 is then floated between the two pairs of pillars 3. The bottom hull assembly ballast is then partially removed so that the pillars emerge and the top hull rests on the supports 16, reaching its final position and partially resting its weight on said supports. The lateral connections fixing the top hull to the pillars are then welded.

The nature of the invention, and the way in which it is to be performed, having been sufficiently described, it should be noted that the above features may be modified as to detail without departing from the fundamental scope of the invention.

What is claimed is:

1. In a floating apparatus of the semi-submersible type having two bottom hulls, a plurality of central pillars extending upwardly from said hulls, said central pillars each having an upper portion and at least one top hull connected to the upper portions of said central pillars, the improvement comprising:

said bottom and top hulls each comprising an elongate floating body, said top hull extending transversely of said bottom hulls, means for connecting said top hull to said central pillars at points laterally adjacent the upper portions of said central pillars, outer pillar means, located at each end of said bottom hulls, for controlling the rocking movement and stability of the apparatus, said outer pillar means having a cross section which decreases from each end toward an intermediate section thereof, wherein the portions of said outer pillar means above said intermediate section are emergent while the portions therebelow are submerged in the working position and are emergent in the navigational position of the apparatus.

2. The improvement according to claim 1, wherein each of the central pillars supporting said top hull comprises pairs of vertically arranged elements interconnected in substantially H-shaped configuration.

3. The improvement according to claim 1, wherein the central pillars supporting said top hull comprise pairs of elements inclined from the vertical and interconnected in a substantially upright V-shaped configuration.

4. The improvement according to claim 1, including means, connected to the sides of the upper portions of said central pillars for suspending and raising the top hull.

5. A method of assembling a floating apparatus comprising two bottom hulls and a top hull, said hulls being individually constructed and floated, said bottom hulls having pairs of central pillars extending upwardly from said bottom hulls comprising the steps of:

interconnecting said bottom hulls, ballasting said bottom hulls until the same are submerged slightly beneath the level of a body of water, introducing said top hull in an afloat condition between said central pillar pairs and transversely with respect to said bottom hulls, deballasting said bottom hulls to raise said top hull above the water level, raising further said top hull by mechanical means above said water level to a point adjacent an upper portion of said central pillar pairs, and securing laterally said top hull to said central pillars.

* * * * *